US006641061B1

(12) United States Patent
Hsieh

(10) Patent No.: US 6,641,061 B1
(45) Date of Patent: Nov. 4, 2003

(54) SPRAY ASSEMBLY FOR USE IN A KITCHEN

(76) Inventor: Max Hsieh, No. 78, Lane 234, Sec. 3, Chang-Nan Rd., Changhua City (TW)

( * ) Notice: Subject to any disclaimer, the term of this patent is extended or adjusted under 35 U.S.C. 154(b) by 0 days.

(21) Appl. No.: 10/265,627

(22) Filed: Oct. 8, 2002

(51) Int. Cl.[7] ..... B05B 7/02; B05B 9/01; A62C 31/00

(52) U.S. Cl. ..... 239/526; 239/439; 239/441; 239/443; 239/436; 239/525

(58) Field of Search ..... 239/525, 526, 239/436–444, 446–449, 590, 590.3, 590.5, 553, 553.3, 553.5

(56) References Cited

U.S. PATENT DOCUMENTS 3,588,040 A * 6/1971 Ward ..... 251/244
4,618,100 A * 10/1986 White et al. ..... 239/440
5,662,276 A * 9/1997 Ko ..... 239/571
5,806,771 A * 9/1998 Loschelder et al. ..... 239/446
5,979,800 A * 11/1999 Takagi ..... 239/440
6,151,729 A * 11/2000 Yean ..... 4/675
6,173,910 B1 * 1/2001 Yean ..... 239/525
2003/0001028 A1 * 1/2003 Brattoli et al. ..... 239/525

* cited by examiner

*Primary Examiner*—Michael Mar
*Assistant Examiner*—Darren Gorman
(74) *Attorney, Agent, or Firm*—Rosenberg, Klein & Lee

(57) ABSTRACT

A spray assembly for use in a kitchen includes a body with a first section and a second section extending from the first section. The body includes an inlet defined in a first end of the body and connected to a water source. A first chamber is defined in the first section and communicates with the inlet. A second chamber is defined in the second section and extends to a second end of the body. A path is defined in the body and communicates with the first chamber and the second chamber. A piston is reciprocally received in the body to close the path. A trigger is pivotally on the body to downward drive the piston to open the path. A sprinkling device is mounted to the second end of the body for controlling water current that sprinkles from the sprinkling device.

8 Claims, 7 Drawing Sheets

SPRAY ASSEMBLY FOR USE IN A KITCHEN

BACKGROUND OF THE INVENTION

1. Field of the Invention

The present invention relates to a spray assembly, and more particularly to a spray assembly for use in a kitchen.

2. Description of Related Art

A conventional spray assembly for use in a kitchen in accordance with the prior art shown in FIG. 7 comprises an inverted L-shaped body having a first section (61) used as a grip and a second section extending from the first section (61) of the body. A first chamber (64) is defined in the first section (61) of the body and a second chamber (63) defined in the second section of the body. A passage (60) is defined in the body and communicates with the first chamber (64) and the second chamber (63). An inlet (62) is formed on one end of the first section (61) opposite to the second section and communicates with the first chamber (64). Multiple outlets (631) are defined in a free end of the second section of the body. A piston (66) is movably mounted in the body for closing the passage (60) and partially extends through the body. A trigger (65) is pivotally mounted on an outer periphery of the body for driving the piston (66) to open the passage (60) and make the first chamber (64) communicate with the second chamber (63).

The water directly sprays out from the outlet (631) for cleaning the oil sludge or the cleaner on the tableware when the trigger (65) is pressed. However, the water flow is very powerful because it directly sprays from the outlet (631). The powerful water flow will splash everywhere after meeting the tableware and wet the floor of the kitchen. However, a wet floor is very dangerous to an old man or a child because they easily slip and fall on the wet floor.

The present invention has arisen to mitigate and/or obviate the disadvantages of the conventional spray assembly for use in a kitchen.

SUMMARY OF THE INVENTION

The main objective of the present invention is to provide an improved spray assembly for use in a kitchen that provides two choices of water current to prevent the water from splashing everywhere wetting the floor of the kitchen after meeting the tableware to wash away the dregs and the greasy dirt on the tableware.

To achieve the objective, the spray assembly in accordance with the present invention comprises a body with a first section and a second section extending from the first section. The body includes an inlet defined in a first end of the body and connected to a water source. A first chamber is defined in the first section and communicates with to the inlet. A second chamber is defined in the second section and extends to a second end of the body. A path is defined in the body and communicates with the first chamber and the second chamber. A piston is reciprocally received in the body to close the path. A trigger is pivotally on the body to downward drive the piston to open the path. A sprinkling device is mounted to the second end of the body for controlling water current that sprinkles from the sprinkling device.

Further benefits and advantages of the present invention will become apparent after a careful reading of the detailed description with appropriate reference to the accompanying drawings.

DETAILED DESCRIPTION OF THE INVENTION

Figure 1:
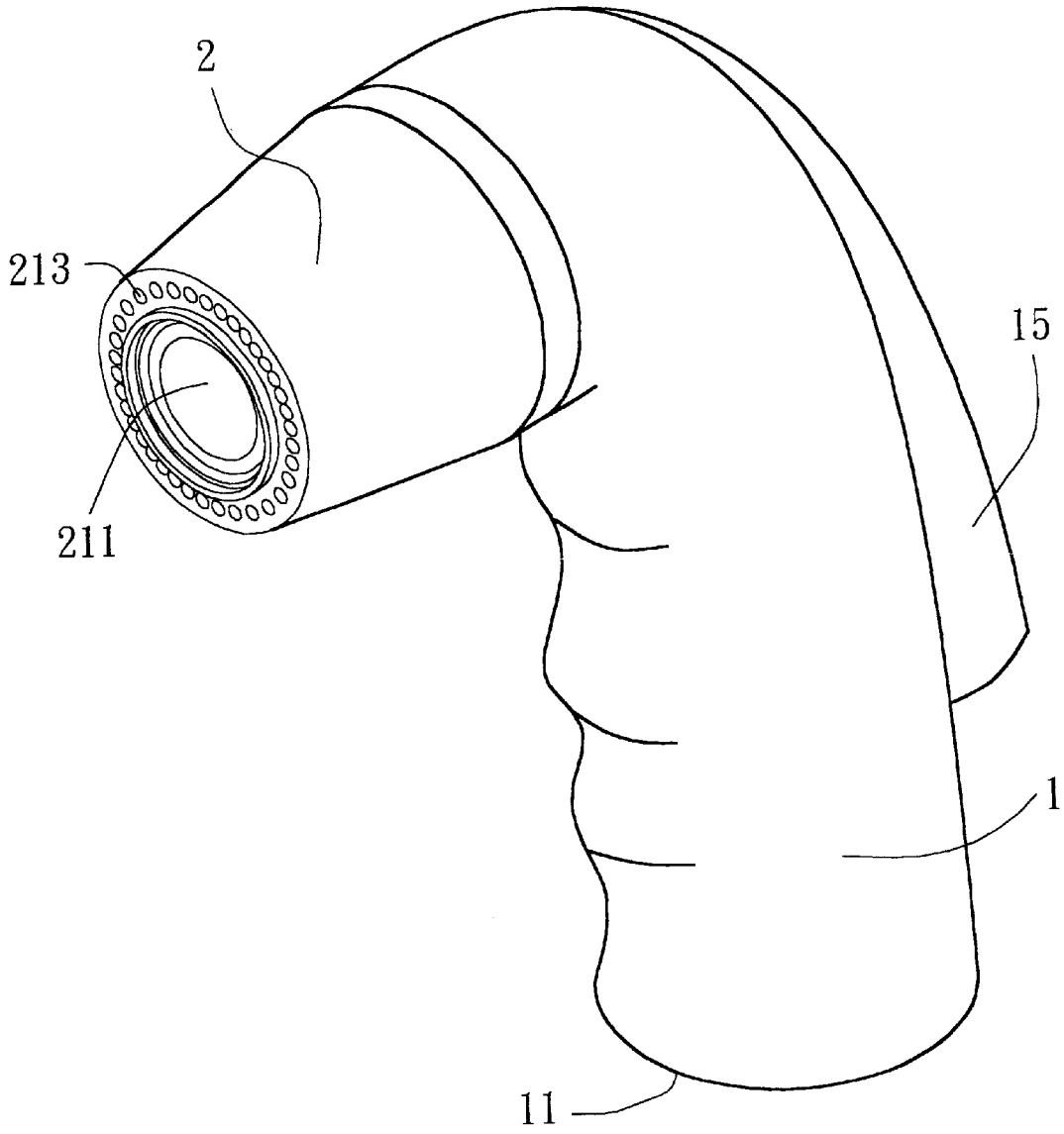
FIG. 1 is a perspective view of a spray assembly for use in a kitchen in accordance with the present invention.
Figure 2:
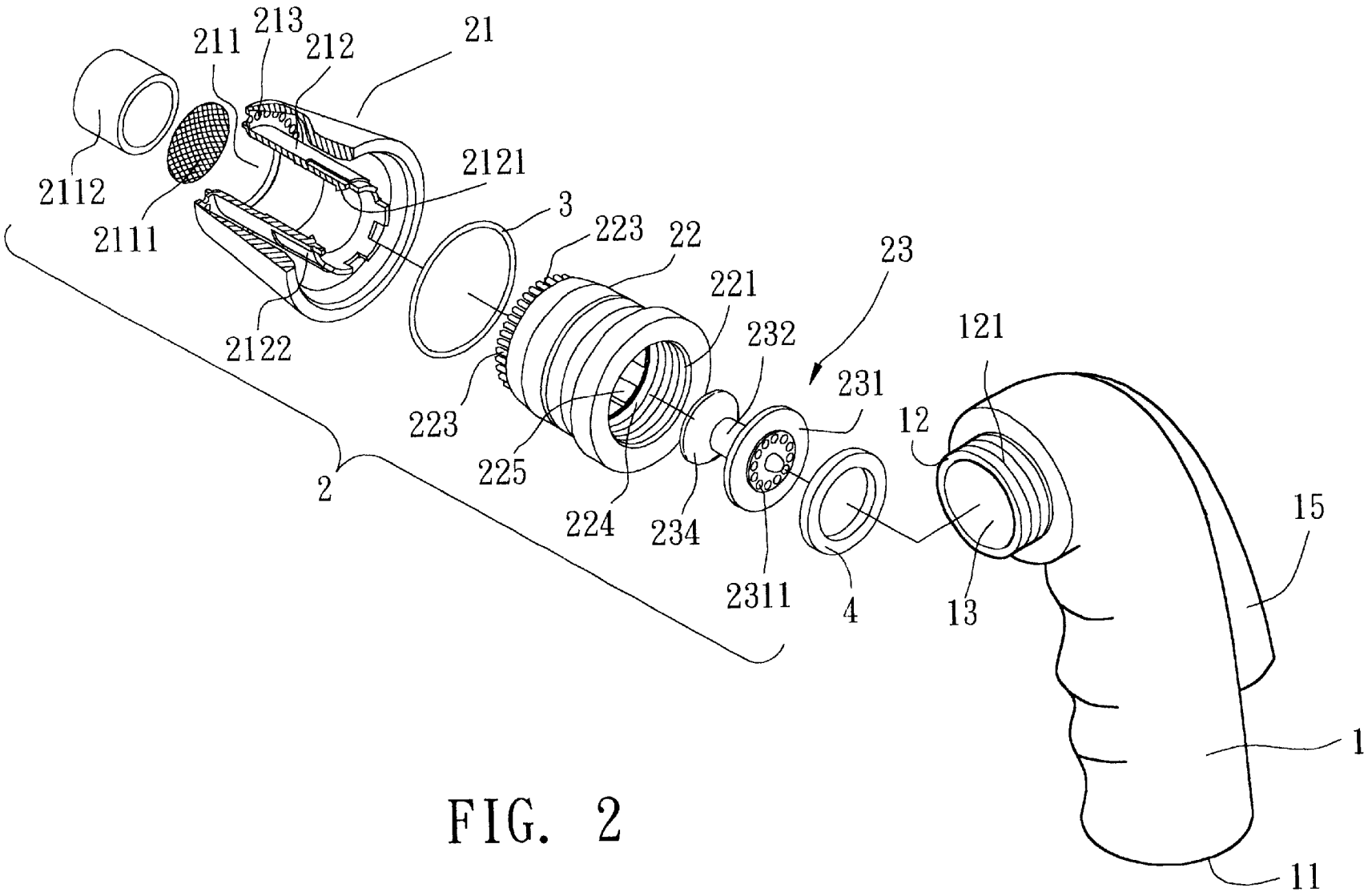
FIG. 2 is an exploded perspective view of the spray assembly for use in a kitchen in FIG. 1.
Figure 3:
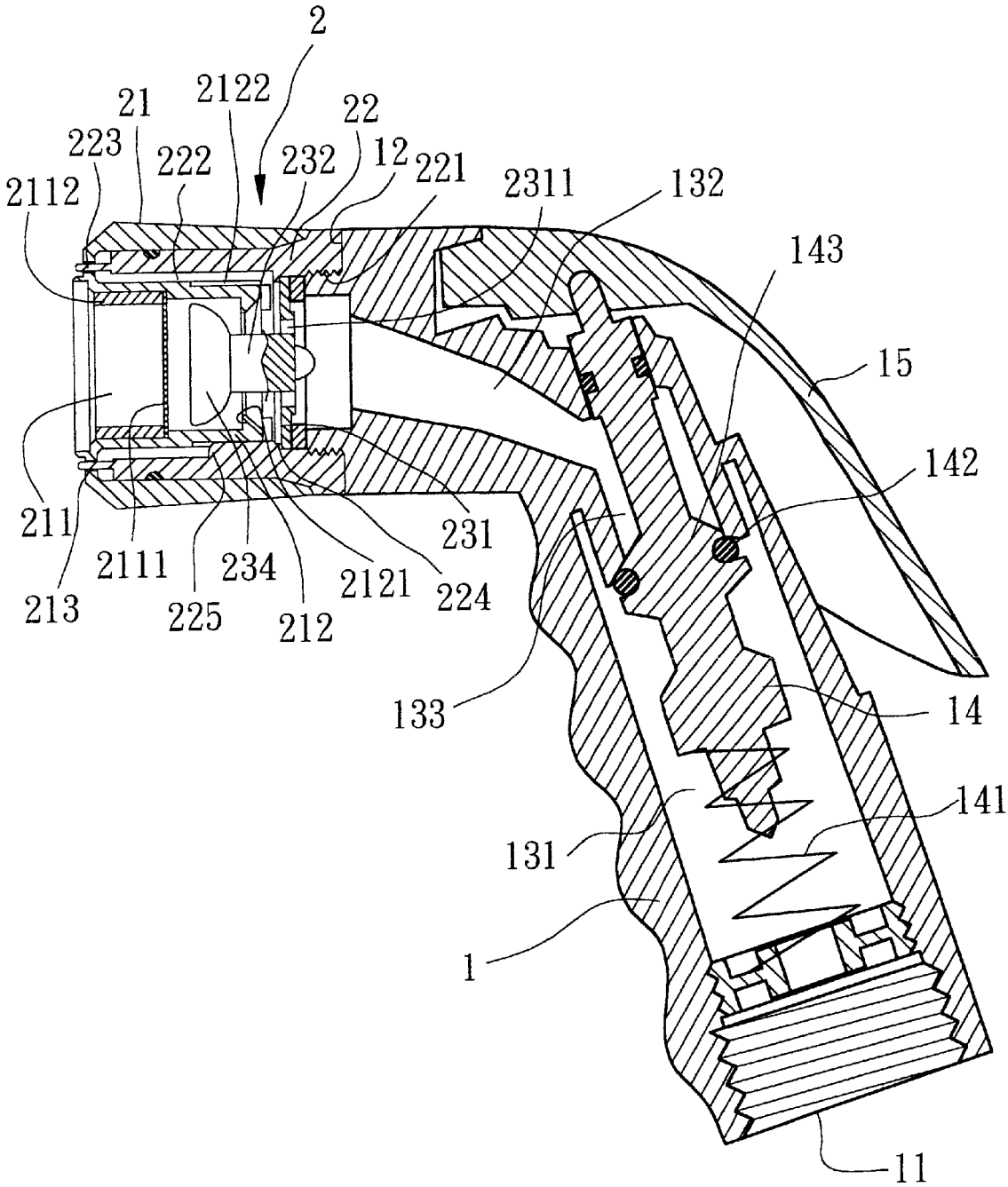
FIG. 3 is a side cross-sectional view of the spray assembly for use in a kitchen.

Referring to the drawings and initially to FIGS. 1–3, a spray assembly for use in a kitchen in accordance with the present invention comprises a body (1) and a sprinkle device (2) mounted to the body (1).

The body (1) is inverted L-shaped and includes a first section and a second section extending from the first section of the body (1). The body (1) has an inlet (11) defined in a first end of the body (1) and an outer threaded portion (121) formed on a second end (12) of the body (1). The inlet (11) is adapted to be connected to a water source. The body (1) includes a first chamber (131) defined in the first section of the body (1) and a second chamber (132) defined in the second section of the body (1). The first chamber (131) communicates with the inlet (11) and the second chamber (132) extends to the second end of the body (1). The body (1) includes a path (133) defined in the body (1) to communicate with the first chamber (131) and the second chamber (132) in the body (1). A piston (14) is reciprocally received in the path (133) and the first chamber (131) in the body (1). The piston (14) has a shoulder (143) radially extending outwardly form a middle portion of the piston (14) and a first o-ring (142) mounted on the shoulder (143) to abut the periphery of the path (133) for closing the path (133). A spring (141) is mounted in the first chamber (131) and between the piston and the inlet (11) to provide a restitution force to the piston (14). The piston (14) has a top portion upwardly extending through the body (1). A lever (15) is pivotally mounted on an outer periphery of the body (1) to press the top portion of the piston (14) to make the shoulder (141) of the piston (14) being separated relative to the path (133) and opening the path (133) such that the first chamber (131) and the second chamber (132) communicate with each other.

The sprinkle device (2) includes a cylinder (22) mounted to the second end (12) of the body (1), a valve (23) securely received in the cylinder (22) and an end cap (21) slidably mounted around the cylinder (22).

The cylinder (22) has an inner threaded portion (221) formed on an inner periphery of the cylinder (22). The inner threaded portion (221) is screwed onto the threaded portion (121) on the second end (12) of the body (1) to secure the cylinder (22) on the body (1). The cylinder (22) includes a shoulder (224) radially extending from the inner periphery of the cylinder (22) near a middle portion of the cylinder (22) and multiple protrusions (225) longitudinally extending from the inner periphery of the cylinder (22) near the shoulder (224) opposite to the inner threaded portion (221). The cylinder (22) has a first side securely abutting the second end of the body (1) after the sprinkle device (2)

screwed onto the body (1) and a second side having a series of stubs (223) longitudinally from the cylinder (22) and being perpendicular relative to the second side of the cylinder (22).

The valve (23) includes a shank (232) having a first end within the inner threaded portion (221) of the cylinder (22) and a second end extending toward the end cap (21). A plate (231) radially extends from the first end of the shank (232) and abuts the shoulder (224) of the cylinder (22). A resilient washer (4) is securely positioned between the plate (231) and the second end of the body (1) to provide a waterproof function to the present invention. The plate (231) includes multiple through holes (2311) defined therein within the resilient washer (4) and around the shank (232). A stopper (234) radially extends from the second end of the shank (232) and is tapered relative to the plate (231). A second o-ring (3) is mounted around an outer periphery of the cylinder (22) near the middle portion of the cylinder (22).

The end cap (21) includes an open end facing the second end (12) of the body (1) and a close end opposite to the open end of the end cap (21). A tubular stub (212) centrally and perpendicularly extends from the close end of the end cap (21) and a through hole (211) is longitudinally defined in the tubular stub (212). The tubular stub (212) extends into the cylinder (22) to form a path (222) between the tubular stub (212) and the cylinder (22). The through hole (211) extends through the end cap (21). An annular hook (2121) is formed and extending from an inner periphery of the through hole (211) near the open end of the end cap (21) and defines a passage (233) within the annular hook (2121). The passage (233) has a diameter slightly smaller than that of the stopper (234). Multiple grooves (2122) are longitudinally defined in an outer periphery of the tubular stub (212) near the open end of the end cap (21). Each groove (2122) in the tubular stub (212) slidably receives a corresponding one of the protrusions (225) of the cylinder (22). A series of sprinkling holes (213) is defined in the close end of the end cap (21) between the tubular stub (212) and the outer periphery of the end cap (21). Each sprinkling hole (213) aligns with a corresponding one of the stubs (223) of the cylinder (22). A net (2111) disposed in the tubular stub (212) and a locking ring (2112) is securely inserted into the tubular stub (212) to abut the net (2111) for holding the net (2111) in place in the tubular stub (212).

Figure 4:
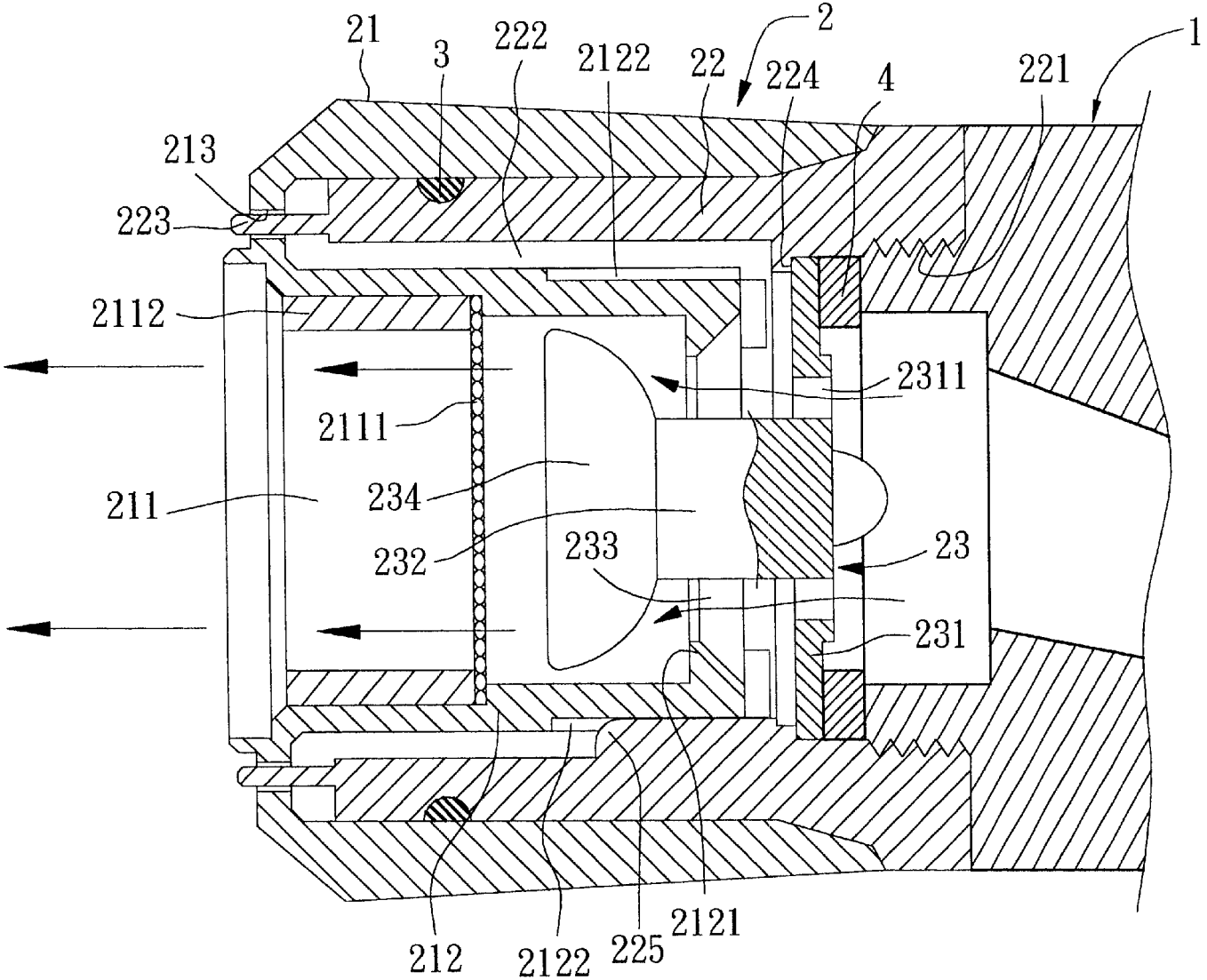
FIG. 4 is an operational side cross-sectional view of a sprinkle device of the spray assembly for use in a kitchen.

To assemble the spray assembly for use in a kitchen in accordance with the present invention, the valve (23) is received within the cylinder (22), the plate (231) of the valve (23) abuts the shoulder (224) of the cylinder (22) and the stopper (234) extends through the shoulder (224) of the cylinder (22). The valve (23) and the first o-ring (4) are securely positioned when the cylinder (22) is securely screwed onto the threaded portion (121) of the body (1). The end cap (21) is pressed toward the body (1) to make the stopper (234) snapped through the annular hook (2121) and abuts the second o-ring (3) such that the end cap (21) is connected to the valve and movable relative to the cylinder (22) because the stopper (234) has a diameter greater than that of the passage (233) within the annular hook With reference to FIGS. 4 and 6, the end cap (21) is pressed to the body (1) such that the passage (233) is opened and the stubs (223) of the cylinder (22) each extends through a corresponding one of the sprinkling holes (213) in the end cap (21). Consequently, the water current flows through the through hole (2311) in the valve (23), the passage (233), the through hole (211) in the end cap (21) and the net (2111) after downward pushing the trigger (15) to downward drive the piston (14) to open the path (133) in the body (1). The water current is foamed after flowing the net (2111) so that the intensity of the water current is weakened to prevent the water from splashing everywhere and wetting the floor of the kitchen after meeting the tableware.

Figure 5:
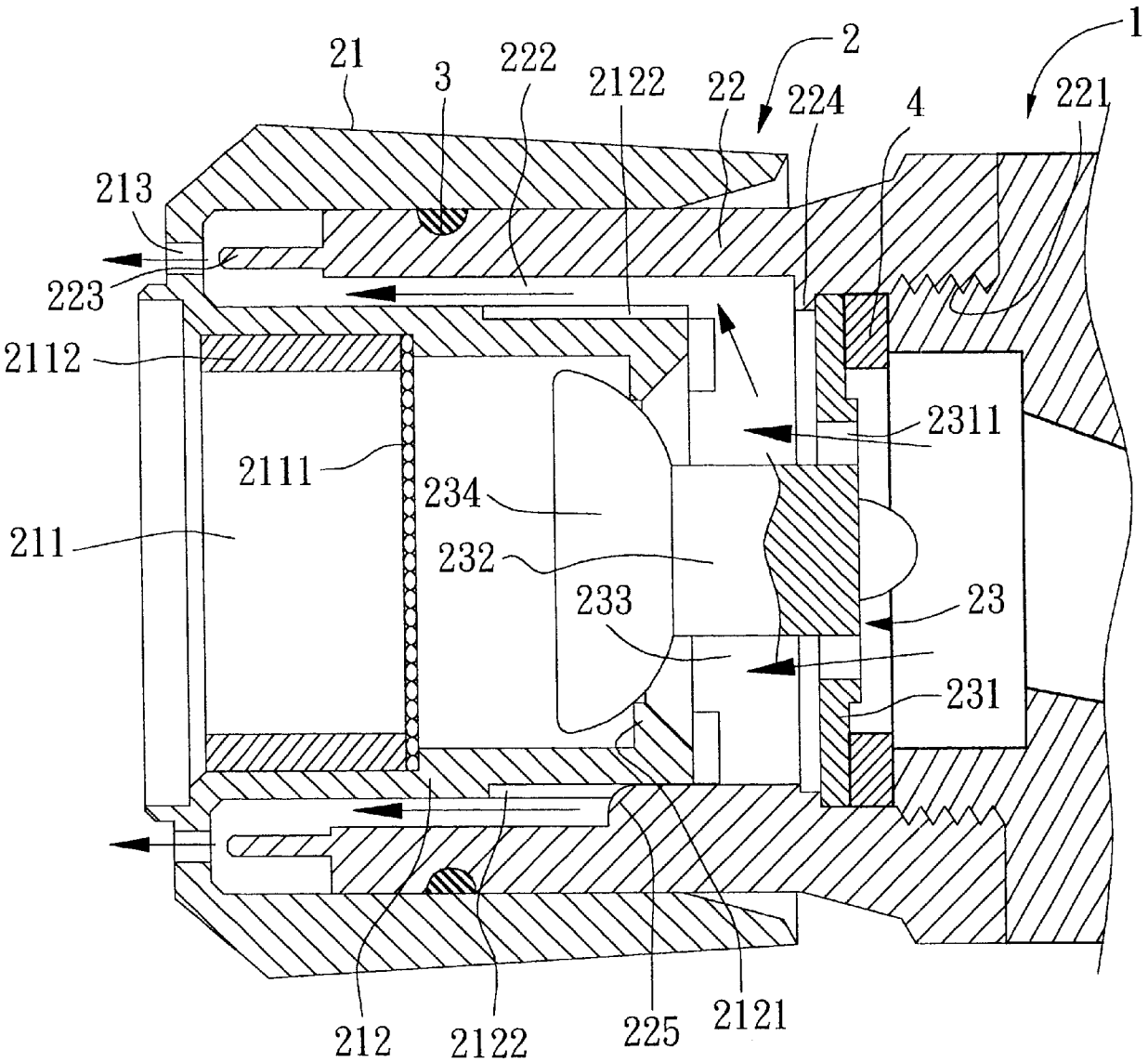
FIG. 5 is another operational side cross-sectional view of the sprinkle device of the spray assembly for use in a kitchen.
Figure 6:
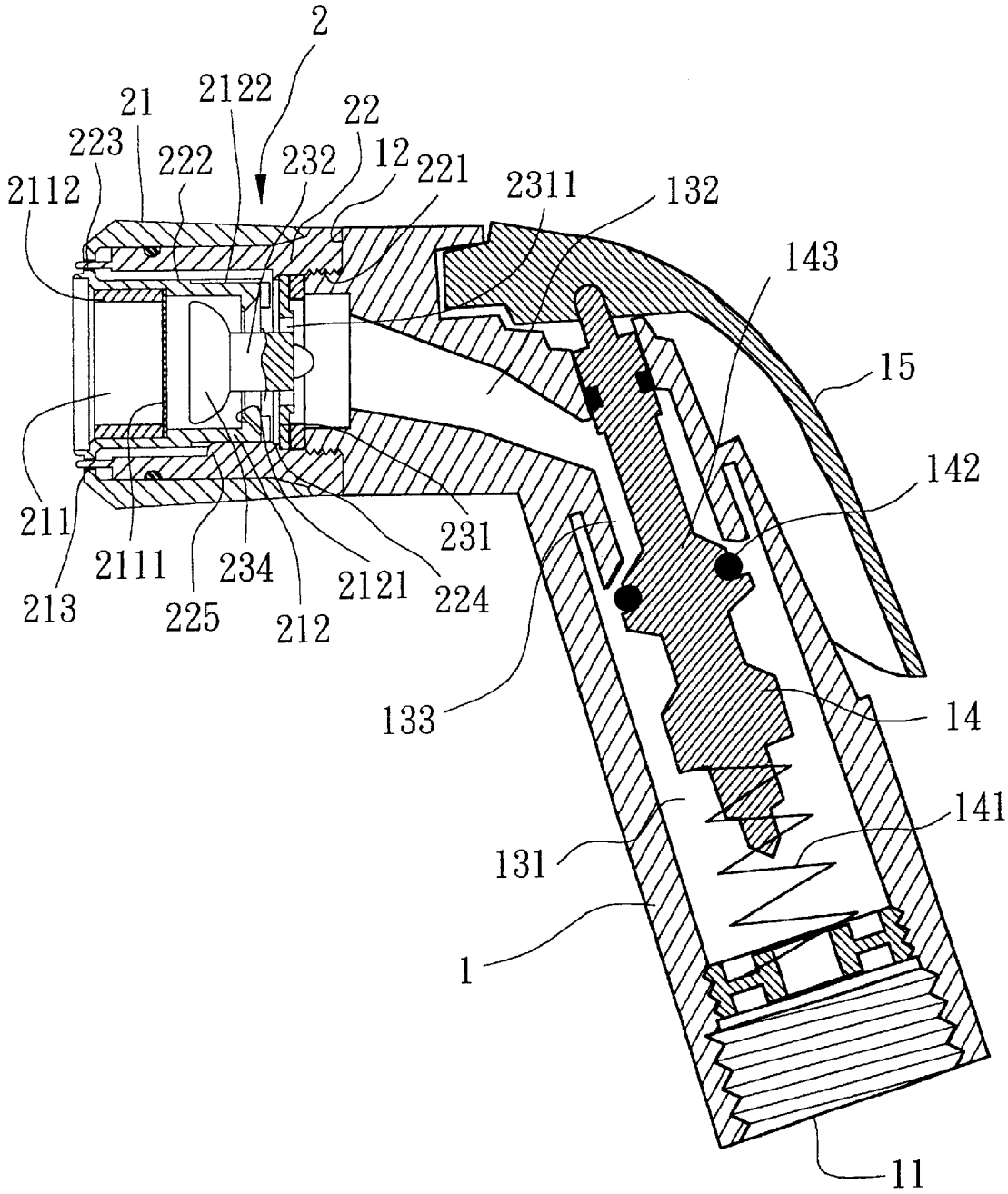
FIG. 6 is an operational side cross-sectional view of the lever of the spray assembly in FIG. 1.
Figure 7:
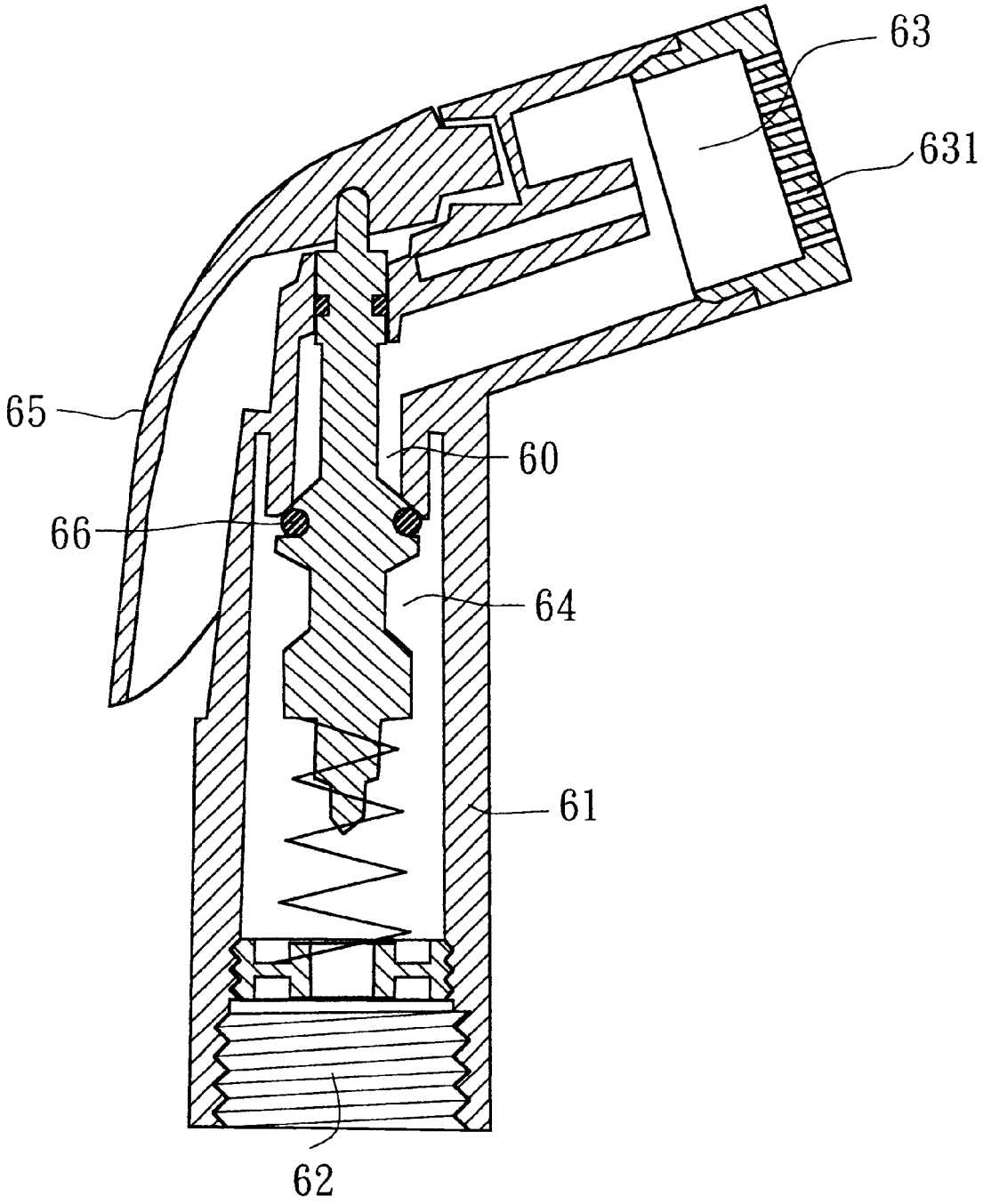
PRIOR ART FIG. 7
FIG. 7 is a side cross-sectional view of a spray assembly for use in a kitchen in accordance with the prior art.

With reference to FIGS. 5 and 6, the end cap (21) is moved opposite to the body (1) such that the annular hook (2121) abuts the stopper (234) to close the passage (233) and the stubs (223) of the cylinder (22) is drawn out from the sprinkling hole (213) in the end cap (21). Consequently, the water current flows through the through hole (2311) in the valve (23), the path (222) between the cylinder (22) and the end cap (21) and sprinkling out from the sprinkling hole (213) in the end cap (21) after downward pushing the trigger (15) to downward drive the piston (14) to open the path (133) in the body (1). The sprinkling water can wash away the dregs and the greasy dirt on the tableware.

As described above, the spray assembly in accordance with the present invention provides two choices of water current to prevent the water from splashing everywhere and wetting the floor of the kitchen after meeting the tableware to wash away the dregs and the greasy dirt on the tableware. Consequently, the present invention has arisen to mitigate and/or obviate the disadvantages of the conventional spray assembly for use in a kitchen.

Although the invention has been explained in relation to its preferred embodiment, it is to be understood that many other possible modifications and variations can be made without departing from the spirit and scope of the invention as hereinafter claimed.

What is claimed is:

1. A spray assembly for use in a kitchen, comprising:

a body with a first section and a second section extending from the first section, the body including:

an inlet defined in a first end of the body, the inlet adapted to be connected to a water source;

a first chamber defined in the first section of the body and communicating with the inlet in the body;

a second chamber defined in the second section of the body and extending to a second end of the body, the second end of the body opposite to the first end of the body;

a path defined in the body and communicating with the first chamber and the second chamber;

a piston reciprocally received in the body to close the path in the body; and a trigger pivotally on the body to downward drive the piston to open the path in the body; and a sprinkling device mounted to the second end of the body for controlling water current that sprinkles from the sprinkling device, the sprinkling device including:

a cylinder mounted to the second end of the body, the cylinder including a shoulder radially extending from an inner periphery and near a middle portion of the cylinder;

a valve received in the cylinder, the valve including a first end having a plate radially extending from the first end of the valve and a second end having a stopper radially extending from the second end of the valve, the plate securely positioned between the shoulder and the second end of the body when the cylinder is mounted to the body, multiple through holes defined in the plate within the shoulder to allow the water current flowing through the valve; and an end cap movably mounted around the cylinder, the end cap including:

an open end facing the second end of the body and a close end opposite to the open end of the end cap;

a tubular stub centrally and perpendicularly extending from the close end of the end cap to form a path between the tubular stub and the cylinder, and having a through hole longitudinally defined in the tubular stub;

a series of sprinkling holes defined in the close end of the end cap between the tubular stub and an outer periphery of the end cap; and an annular hook extending from an inner periphery of the through hole in the tubular stub near the open end of the end cap and defining a passage within the annular hook, the annular hook having a diameter smaller than that of the stopper and selectively abutting the stopper to close the passage in the tubular stub.

2. The spray assembly as claimed in claim 1, wherein the cylinder comprises multiple protrusions longitudinally extending from the inner periphery of the cylinder near the shoulder opposite to the second end of the body, and the end cap comprises multiple grooves longitudinally defined in an outer periphery of the tubular stub near the open end of the end cap, each groove in the tubular stub slidably receiving a corresponding one of the protrusions.

3. The spray assembly as claimed in claim 1, wherein the cylinder comprises a series of stubs perpendicularly extending from one side of the cylinder toward the close end of the end cap, each stub of the cylinder selectively received in a corresponding one of the sprinkling holes in the end cap.

4. The spray assembly as claimed in claim 1, wherein the end cap comprises a net disposed in the tubular stub and a locking ring is securely inserted into the tubular stub to abut the net for holding the net in place.

5. The spray assembly as claimed in claim 2, wherein the cylinder comprises a series of stubs perpendicularly extending from one side of the cylinder toward the close end of the end cap, each stub of the cylinder selectively received in a corresponding one of the sprinkling holes in the end cap.

6. The spray assembly as claimed in claim 2, wherein the end cap comprises a net disposed in the tubular stub and a locking ring is securely inserted into the tubular stub to abut the net for holding the net in place.

7. The spray assembly as claimed in claim 3, wherein the end cap comprises a net disposed in the tubular stub and a locking ring is securely inserted into the tubular stub to abut the net for holding the net in place.

8. The spray assembly as claimed in claim 4, wherein the end cap comprises a net disposed in the tubular stub and a locking ring is securely inserted into the tubular stub to abut the net for holding the net in place.

* * * * *